US006527914B1

(12) United States Patent
Shevchenko et al.

(10) Patent No.: US 6,527,914 B1
(45) Date of Patent: Mar. 4, 2003

(54) METHOD OF ENHANCING BRIGHTNESS AND BRIGHTNESS STABILITY OF PAPER MADE WITH MECHANICAL PULP

(75) Inventors: Sergey M. Shevchenko, Aurora, IL (US); Prasad Y. Duggirala, Naperville, IL (US)

(73) Assignee: Ondeo Nalco Company, Naperville, IL (US)

( * ) Notice: Subject to any disclaimer, the term of this patent is extended or adjusted under 35 U.S.C. 154(b) by 0 days.

(21) Appl. No.: 10/066,271

(22) Filed: Jan. 30, 2002

(51) Int. Cl.[7] ..... D21H 21/38

(52) U.S. Cl. ..... 162/142; 162/150; 162/162; 162/158; 162/160; 162/164.6

(58) Field of Search ..... 162/142, 150, 162/158, 160, 164.6; 422/1

(56) References Cited

U.S. PATENT DOCUMENTS

| | | | | | |
|---|---|---|---|---|---|
| 5,368,689 | A | * | 11/1994 | Agnemo | 162/160 |
| 5,658,431 | A | * | 8/1997 | Janson et al. | 162/160 |
| 5,928,473 | A | * | 7/1999 | Avila et al. | 162/160 |
| 6,030,495 | A | | 2/2000 | Wan et al. | |
| 6,059,927 | A | | 5/2000 | Wan et al. | |
| 6,447,644 | B1 | * | 9/2002 | Seltzer et al. | 162/160 |

FOREIGN PATENT DOCUMENTS

| | | |
|---|---|---|
| EP | 0 943 665 A1 | 9/1999 |
| WO | WO 95/35331 | 12/1995 |
| WO | WO 99/05108 | 2/1999 |

OTHER PUBLICATIONS

Wan, J.K.S., Depew, M.C., "Some mechanistic insights in the behavior of thiol–containing antioxidant polymers in lignin oxidation process", Res. Chem. Intermed., vol. 22, No. 3, pp. 241–253, 1996.

Barbara J.W.Cole, Kyosti V. Sarkanen, "Bleaching and brightness stabilization of high–yield pulps by sulfur–containing compounds", TappiJournal, pp. 117–122, Nov. 1987.

P. McGarry, C. Heitner, J. Schmidt, R. Seltzer, G. Cunkle and J.–P. Wolf, "Hindered Nitroxide: A New Yellowing Inhibitor for Mechanical Pumps", Journal of Pulp and Paper Science, vol. 26, No. 2, pp. 59–66, Feb. 2000.

* cited by examiner

*Primary Examiner*—Peter Chin
(74) *Attorney, Agent, or Firm*—Margaret M. Brumm; Thomas M. Breininger

(57) ABSTRACT

Methods to enhance the brightness and brightness stability of paper and paperboard made with Mechanical Pulp are described and claimed. The method involves applying a Penetrant Compound to paper or paperboard in an amount from about 0.001 percent to about 1 percent by weight. The Penetrant Compound can have one component that is either polyamino polyether methylene phosphonate (PAPEMP) and α-glucoheptonic-γ-lactone (GL); or the Penetrant Compound can have two components, where the first component is selected from the group consisting of PAPEMP and GL and the second component is an inorganic salt; or the Penetrant Compound can have three components where one component is selected from the group consisting of PAPEMP and GL, the second component is selected from the group consisting of 3,5-dimethylperhydrothiadiazine-2-thion and dialkyldithiocarbamates and the third component is an inorganic salt.

12 Claims, No Drawings

METHOD OF ENHANCING BRIGHTNESS AND BRIGHTNESS STABILITY OF PAPER MADE WITH MECHANICAL PULP

FIELD OF THE INVENTION

This invention relates generally to methods and chemical compositions used to enhance brightness and brightness stability of paper made with Mechanical Pulp.

BACKGROUND OF THE INVENTION

There are three major types of pulping methods known in the Pulp and Paper Industry. The first is Chemical and the second is Mechanical and the third is a Combination of Chemical and Mechanical.

Because Chemical pulps are not the subject of the instant claimed invention, there will be no extensive discussion of them in this patent application.

The first step in the Mechanical pulping process is the grinding or refining of wood.

The Stone Groundwood (SGW) process involves making pulp by pressing logs and chips against an abrasive rotating surface. Many years ago the grinding surface used was an actual stone. In current practice specifically designed "artificial pulp stones" are available for the grinding.

A Pressurized GroundWood (PGW) process is where the grinding operation is completely pressurized.

Another type of Mechanical pulping is Refiner Mechanical Pulp (RMP) featuring atmospheric refining with no pretreatment of the wood chips. This process is one of the main mechanical pulping operations.

Thermo Mechanical Pulping (TMP) is a Mechanical pulping process that evolved from RMP and a high temperature process known as the Apslund process. Thermo Refiner Mechanical Pulping (TRMP) is a variation in Thermo Mechanical Pulping. In this case, the chips are preheated under pressure and refining is carried out at atmospheric pressure. TMP and TRMP pulps are stronger than either SCW or RMP pulps.

The third type of pulping process is a Combination of Chemical and Mechanical pulping processes. Two types of Combination processes are ChemiMechanical Pulping and SemiMechanical Pulping. There is little difference between ChemiMechanical Pulping (CMP) and SemiChemical Mechanical Pulping (SCMP). Both processes involve pretreatment of chips with chemicals, followed by mechanical refining. Four different chemical treatments are associated with these processes. These chemical treatments are: sodium hydroxide, sodium bisulfite, sodium sulfite, and acid sulfite treatment. These processes are generally used on hardwoods. Chemical treatment weakens the fiber structure allowing fibers to rupture similarly to softwood that is mechanically pulped.

ChemiThermoMechanical Pulping (CTMP) appears to be a full evolution of all Mechanical pulping methods. It includes chemical treatment at elevated temperature steaming followed by mechanical refining. This process can produce fibrous raw materials that vary considerably in properties depending upon process conditions such as sodium sulfite concentration, pH, temperature, etc.

With all paper, "paper brightness" is a measurement of the ability of a sample to reflect monochromatic (457 nm) light as compared to a known standard, using magnesium oxide (MgO). Since cellulose and hemicellulose are white, they do not contribute to paper color. It is generally agreed that the lignin present in the paper is responsible for any color of the paper. The chromophores are believed to be quinone-like materials formed from the lignin's phenolic groups through an oxidative mechanism. Additionally, heavy metal ions, especially iron and copper, can form colored complexes with the phenolic groups.

There are generally two approaches to removing color. The first uses a selective chemical to destroy the chromophores but not the lignin. The other approach is to use a bleaching system to remove the residual lignin. The bleaching of pulp is the standard method of removing color from pulp. It is current state of the art technology for all Chemical and Mechanical pulps to be bleached. Even with bleaching it is common for paper made with Mechanical Pulp to have unwanted color present.

Mechanical pulps can be used in furnishes for the manufacture of business forms, writing papers, and high grade publication papers for books; which are all long-life uses requiring paper that does not yellow with age. However, papers made with Mechanical pulps are known to turn yellow during use. This yellowing restricts their use to applications requiring only a short-life for the paper. If the time taken before yellowing of these papers begins could be increased, the potential market for bleached TMP and CTMP would be expanded significantly. If the tendency to yellow, also known as "brightness reversion", could be prevented, bleached TMP and CTMP could be included in furnishes used to manufacture high brightness papers. Displacing significant amounts of more expensive fully bleached, low yield chemical pulps with less expensive high yield Mechanical pulps promises significant economical benefits. On the other hand, even simple sustainable increase of brightness resulting from an inexpensive chemical treatment may be of a significant commercial value for paper mills.

Photoyellowing occurs primarily in finished paper while thermal aging occurs in both pulp and finished paper. It is thought that photoyellowing results mainly from radical photochemical reactions of residual lignin in pulp. Therefore, high-lignin pulps and products containing such pulps are more susceptible to brightness loss than more expensive, low-lignin pulps. Phenoxyl, hydroxyl, alkoxyl and peroxyl radicals are likely intermediates in the process. Consequently, radical scavengers and hydrogen donors provide protection against photoyellowing.

The mechanism of thermal aging is much less understood. From a practical point of view, thermal aging results in two separate problems. First, it is a slow brightness loss in finished paper. Second, it is a fast brightness loss in pulp itself that occurs at a pulp and paper mill during the storage and processing, and also during formation of paper (especially in the dryer).

What has been determined is that these two unwanted processes occur simultaneously in finished paper. Therefore, any effective composition designed to provide stabilization and increase in brightness must positively impact both of these unwanted processes. This is a major challenge in developing remedies against the brightness loss because the two processes develop along different chemical mechanisms. Thermal aging becomes a more important process in a common situation when paper or paper products are stored without extensive exposure to light. However, there is general understanding of importance for both thermal aging and photoyellowing of some common factors such as the pH of the paper as well as the content and state of transient metal ions in them.

The known classes of chemicals that provide limited protection against yellowing of mechanical pulps include radical scavengers and antioxidants, phosphites, dienes, aliphatic aldehydes, UV screens, chelating agents, and polymeric inhibitors. However, usually the amounts of chemicals required for adequate protection are unrealistically high (on the order of 5 percent) and, besides, these compounds carry other undesirable traits, such as high toxicity and some of them have unpleasant odors. Examples of chemicals with these undesirable effects are low-molecular-weight and polymeric thiols such as 1-thioglycerol, glycol dimercaptoacetate, polyethyleneglycol dithiolactate, which do inhibit photoyellowing, however, such chemicals are usually malodorous. Furthermore, these types of chemical typically have to be applied in quantities that are not economically feasible.

A synergistic mixture of a radical scavenger 4-hydroxy-2,2,6,6-tetramethylpiperidine N-oxyl (HO-TEMPO) and 2-(2-hydroxy-3,5-di-tert-amylphenyl)benzotriazole was proposed as an effective inhibitor against both photoyellowing and thermal aging. However, the toxicity of these compounds is known and must be taken into account when using them.

It would be very desirable to discover new compositions that would effectively enhance the initial brightness and brightness stability of paper made with Mechanical Pulp.

SUMMARY OF THE INVENTION

The first aspect of the instant claimed invention is in a method of making paper with Mechanical Pulp comprising the steps of grinding or refining wood to create unbleached pulp and then bleaching the pulp and then forming paper from the pulp, the improvement comprising applying from about 0.01 weight percent to about 1 weight percent of a Penetrant Compound to the paper wherein said Penetrant Compound is selected from the group comprising polyamino polyether methylene phosphonate or α-glucoheptonic-γ-lactone.

The second aspect of the instant claimed invention is in a method of making paper with Mechanical Pulp comprising the steps of grinding or refining wood to create unbleached pulp and then bleaching the pulp and then forming paper from the pulp, the improvement comprising applying from about 0.01 weight percent to about 1 weight percent of a Penetrant Compound to the paper wherein said Penetrant Compound comprises (a) from about 5 weight percent to about 95 weight percent of Component 1, wherein Component 1 is selected from the group consisting of polyamino polyether methylene phosphonate and α-glucoheptonic-γ-lactone;

(b) from about 0.05 weight percent to about 10 weight percent of Component 2, wherein Component 2 is selected from the group consisting of 3,5-dimethylperhydrothiadiazine-2-thion and dialkyldithiocarbamates; and (c) from about 5 weight percent to about 95 percent of Component 3, wherein Component 3 is an inorganic salt, wherein said inorganic salt is selected from the group consisting of monobasic alkaline metal phosphates.

BACKGROUND OF THE INVENTION

It is known to persons of ordinary skill in the art of making pulp and paper how to make a Mechanical Pulp. The Mechanical Pulp can be either a thermomechanical or chemomechanical pulp. It is known that paper is typically made of more than one type of pulp and that it would be unusual to have a paper made with only Mechanical Pulp. Therefore, it is understood that this invention encompasses paper made with some amount of Mechanical Pulp, not just paper made only with Mechanical Pulp. It is also known to persons of ordinary skill in the art of making paper how to make paper with Mechanical Pulp.

The first aspect of the instant claimed invention is in a method of making paper with Mechanical Pulp comprising the steps of grinding or refining wood to create unbleached pulp and then bleaching the pulp and then forming paper from the pulp, the improvement comprising applying from about 0.01 weight percent to about 1 weight percent of a Penetrant Compound to the paper wherein said Penetrant Compound is selected from the group comprising polyamino polyether methylene phosphonate (PAPEMP) or α-glucoheptonic-γ-lactone (GL).

The Compound useful in the method of the first aspect of the instant claimed invention is selected from the group comprising polyamino polyether methylene phosphonate (abbreviated "PAPEMP") or α-glucoheptonic-γ-lactone (abbreviated "GL"). Polyamino polyether methylene phosphonate is available commercially from Ondeo Nalco Company, Ondeo Nalco Center, 1601 W. Diehl Road, Naperville, Ill. 60563 (630) 305-1000, as a 30 percent actives solution under the trade name TRC-289. α-D-Glucoheptonic-γ-lactone is available commercially from Aldrich, P.O. Box 355, Milwaukee, Wis. 53201 USA., telephone number (800) 558-9160.

The amount of polyamino polyether methylene phosphonate or α-glucoheptonic-γ-lactone applied as a Penetrant Compound to the paper or paperboard is from about 0.01 weight percent to about 1 weight percent, based on the dry weight of the pulp. The preferred amount of polyamino polyether methylene phosphonate or α-glucoheptonic-γ-lactone applied as a Penetrant Compound to the paper or paperboard is from about 0.01 weight percent to about 0.5 weight percent, based on the dry weight of the pulp. The most preferred amount of polyamino polyether methylene phosphonate or α-glucoheptonic-γ-lactone applied as a Penetrant Compound to the paper or paperboard is from about 0.02 weight percent to about 0.2 weight percent, based on the dry weight of the pulp.

The Penetrant Compound may be applied to the paper or paperboard using any known technique in the art of papermaking such as spraying, dripping, dip tank coating or even using film coating bars. The preferred method of application for the Penetrant Compound is by spraying the Penetrant Compound onto the paper or paperboard.

It has been found that when the paper or paperboard has applied as a Penetrant Compound from about 0.02 weight percent to about 0.2 weight percent based on the dry weight of the pulp, of either polyamino polyether methylene phosphonate or α-glucoheptonic-γ-lactone, the initial brightness increases from about 1 to about 3 units, and the long-term brightness stability increases from about 10% to about 30%. That increase, in turn results in from about a 3 unit to about a 4 unit gain in brightness after aging compared to a control sample.

It has been found that it is possible to add an inorganic salt to the Penetrant Compound of the first aspect of the instant claimed invention to enhance the brightness of the paper that has the Penetrant Compound applied to it. When inorganic salts are present in the Penetrant Compound of the first aspect of the invention, said Penetrant Compound consists of (a) from about 5 weight percent to about 95 weight percent of a compound selected from the group consisting of polyamino polyether methylene phosphonate and α-glucoheptonic-γ-lactone; and (b) from about 5 weight percent to about 95 percent of an inorganic salt, wherein said inorganic salt is selected from the group consisting of monobasic alkaline metal phosphates.

When inorganic salts are present in the first Aspect of the instant claimed invention, the Penetrant Compound preferably comprises from about 5 to about 95 weight percent of a compound selected from the group consisting of polyamino polyether methylene phosphonate and α-glucoheptonic-γ-lactone and from about 5 to about 95 weight percent of inorganic salt; more preferably comprises from about 5 to about 70 weight percent of a compound selected from the group consisting of polyamino polyether methylene phosphonate and α-glucoheptonic-γ-lactone and from about 30 to about 95 weight percent of inorganic salt; and most preferably comprises from about 10 to about 50 weight percent of a compound selected from the group consisting of polyamino polyether methylene phosphonate and α-glucoheptonic-γ-lactone and from about 50 to about 90 weight percent of inorganic salt.

Inorganic salts suitable for addition to the Penetrant Compound of the first aspect of the instant claimed invention are selected from the group consisting of monobasic alkaline metal phosphates. This group includes monobasic sodium phosphate and monobasic potassium phosphate and monobasic lithium phosphate. The preferred inorganic salt is monobasic sodium phosphate ($NaH_2PO_4$). Monobasic sodium phosphate monohydrate is available from Alfa Aesar, 30 Bond St., Ward Hill, Mass. 01835-8099, U.S.A., telephone number (800) 343-0660.

It has been found that when the paper or paperboard has applied as a Penetrant Compound from about 0.01 weight percent to about 1 weight percent based on the dry weight of the pulp, of a mixture of either polyamino polyether methylene phosphonate or α-glucoheptonic-γ-lactone and an inorganic salt, the initial brightness increases from about 2 to about 4 units (higher than from any of the individual components alone), and the long-term brightness stability increases from about 20% to about 30%. That increase, in turn results in from about a 3 unit to about a 5 unit gain in brightness after aging compared to a control sample.

The second aspect of the instant claimed invention is in a method of making paper with Mechanical Pulp comprising the steps of grinding or refining wood to create unbleached pulp and then bleaching the pulp and then forming paper from the pulp, the improvement comprising applying from about 0.01 weight percent to about 0.1 weight percent of a Penetrant Compound to the paper wherein said Penetrant Compound comprises:

(a) from about 5 weight percent to about 95 weight percent of Component 1, wherein Component 1 is selected from the group consisting of polyamino polyether methylene phosphonate and α-glucoheptonic-γ-lactone;

(b) from about 0.05 weight percent to about 10 weight percent of Component 2, wherein Component 2 is selected from the group consisting of 3,5-dimethylperhydrothiadiazine-2-thion and dialkyldithiocarbamate; and (c) from about 5 weight percent to about 95 weight percent of Component 3, wherein Component 3 is an inorganic salt, wherein said inorganic salt is selected from the group consisting of monobasic alkaline metal phosphates.

The Penetrant Compound useful in the second aspect of the instant claimed invention preferably comprises from about 5 to about 95 weight percent of a compound selected from the group consisting of polyamino polyether methylene phosphonate and α-glucoheptonic-γ-lactone, from about 0.05 to about 10 weight percent of a compound selected from the group consisting of 3,5-dimethylperhydrothiadiazine-2-thion and dialkyldithiocarbamate and from about 5 to about 95 weight percent of inorganic salt; more preferably comprises from about 5 to about 70 weight percent of a compound selected from the group consisting of polyamino polyether methylene phosphonate and α-glucoheptonic-γ-lactone, from about 0.1 to about 5 weight percent of a compound selected from the group consisting of 3,5-dimethylperhydrothiadiazine-2-thion and dialkyldithiocarbamate and from about 30 to about 95 weight percent of inorganic salt; and most preferably comprises from about 10 to about 50 weight percent of a compound selected from the group consisting of polyamino polyether methylene phosphonate and α-glucoheptonic-γ-lactone, from about 0.3 to about 1 weight percent of a compound selected from the group consisting of 3,5-dimethylperhydrothiadiazine-2-thion and dialkyldithiocarbamate and from about 50 to about 90 weight percent of inorganic salt.

The Compound useful as Component 2 in the method of the second aspect of the instant claimed invention is selected from the group consisting of 3,5-dimethylperhydrothiazdiazine-2-thion (DMTDA) and dialkyldithiocarbamates. 3,5-Dimethylperhydrothiazdiazine-2-thion is commercially available from Ondeo Nalco Company, Ondeo Nalco Center, 1601 W. Diehl Road, Naperville, Ill. (630) 305-1000, as a 25 percent active solution under the trademark Nalco®248. The family of dialkyldithiocarbamates includes dimethyldithicarbamate and diethyldithicarbamate. Dimethyldithicarbamate (DMDTC) is commercially available from Ondeo Nalco Company as a 40 percent active solution under the trademark Nalco®8154. Diethyldithicarbamate (DEDTC) is commercially available from Alco Chemical, Chattanooga, Tenn. as a 25 percent active solution under the trade name Aquamet E.

Inorganic salts suitable for use as Component 3 are selected from the group consisting of monobasic alkaline metal phosphates. This group includes monobasic sodium phosphate and monobasic potassium phosphate and monobasic lithium phosphate. The preferred inorganic salt for use in the Penetrant Compound of the second aspect of the instant claimed invention is monobasic sodium phosphate.

The amount of Penetrant Compound of the second aspect of the instant claimed invention applied to the paper or paperboard is from about 0.01 weight percent to about 1 weight percent, based on the dry weight of the pulp. The preferred amount of Penetrant Compound of the second aspect of the instant claimed invention applied to the paper or paperboard is from about 0.02 weight percent to about 0.2 weight percent, based on the dry weight of the pulp. The most preferred amount of Penetrant Compound of the second aspect of the instant claimed invention applied to the paper or paperboard is from about 0.03 weight percent to about 0.1 weight percent, based on the dry weight of the pulp.

It has been found that when the paper or paperboard has applied as a Penetrant Compound the Compound of the second aspect of the instant claimed invention the initial brightness increases from about 1 to about 4 units, and the long-term brightness stability increases from about 50 to about 100%. It has also been found that when Component 2 is applied at higher doses, compared to the other components, that the brightness of the paper may initially decrease, but then increase gradually during the aging process (it is reported as "inhibition of brightness loss exceeding 100%") that results in a gain of from about 2 to about 5 units in brightness after aging as compared to a control sample.

With these compositions providing enhanced brightness and brightness stability, of bleached TMP and CTMP, these inexpensive Mechanical pulps can now be used more extensively in paper production without compromising paper properties. They may also become more suitable for special "long-term" applications such as wallpaper.

The following examples are presented to describe preferred embodiments and utilities of the invention and are not meant to limit the invention unless otherwise stated in the claims appended hereto.

EXAMPLES

The following procedure was followed for all the Examples where a Penetrant Compound was applied to paper made with Mechanical pulp.

Handsheets were made of softwood chemo-thermomechanical pulp (CTMP) and stored at constant humidity of 50% and a temperature of 23° C. All experiments were conducted using the same batch of handsheets. Twelve 3×9 centimeters ("cm") samples were cut out of the same handsheet in each series of the experiments. The load of the tested chemicals was determined based on the dry weight of the pulp sample (i.e., 170 mg. average). The chemicals were applied dropwise, as uniformly as possible, as solutions in water. The concentrations of the solutions were chosen to allow application of 200–400 mg of the solution on each sample. The test sheets were dried at room temperature, and then, after measuring the brightness, subjected to the accelerated aging tests as described below. Over the course of this work it was established that changing the mode of application (e.g., soaking instead of dropping) may effect the absolute values of brightness and yellowness but not the trends or relative gains.

Brightness Reversion Experiments (Thermal Aging)

The 3×9 cm samples cut out of the handsheets were kept in a water bath at 70° C. for about 100–200 hours. The samples were then equilibrated at 50% humidity and a temperature of 23° C. before measuring brightness.

Photoyellowing

The 3×9 cm samples cut out of handsheets were kept under "cool white" light (i.e., eight F8T5 CW lamps sold by Litemor Distributors Ltd., Ottawa, Ontario, Canada) on a rotating carrousel at room temperature for about 20 hours. A LZC-1 Photereactor (LuzChem Research, St. Sauveur, QC, Canada) was used in the experiments. The samples were equilibrated in a constant humidity room before measuring brightness.

Assessment of the Effectiveness of Brightness Enhancers

The brightness (R457) and yellowness (E313) were measured on an Elrepho-3000 instrument (Datacolor International, Charlotte, N.C.) with margin of error of ±0.05.

The following parameters were used to assess the effectiveness of brightness enhancers after exposing the samples to thermal aging or photoyellowing:

(a) Brightness gain (GainBr)=[Brightness (sample)−Brightness (control)] after aging (b) Yellowness reduction (LessYe)=[Yellowness (control)−Yellowness (sample)] after aging (c) Percent Brightness reversion inhibition (%IBr)=100×{1-[Initial Brightness (sample)−End Brightness (sample)]÷[Initial Brightness (control)−End Brightness (control)]}

EXAMPLE 1-Thermal Aging

| Chemical | Dose, % to dry pulp | Time, h | Initial Br | Initial Ye | Final Br | Final Ye | GainBr | LessYe | % IBr |
|---|---|---|---|---|---|---|---|---|---|
| Example 1a | | | | | | | | | |
| Control | | 96 | 60.22 | 21.68 | 56.56 | 24.67 | | | |
| PAPEMP | 0.08 | 96 | 61.47 | 21.07 | 58.14 | 23.90 | 1.58 | 0.77 | 9 |
| PAPEMP | 0.03 | 96 | 61.23 | 21.26 | 57.64 | 23.90 | 1.08 | 0.77 | 2 |

-continued

EXAMPLE 1-Thermal Aging

| Chemical | Dose, % to dry pulp | Time, h | Initial Br | Initial Ye | Final Br | Final Ye | GainBr | LessYe | % IBr |
|---|---|---|---|---|---|---|---|---|---|
| GL | 0.25 | 96 | 60.04 | 21.79 | 57.02 | 24.48 | 0.46 | 0.19 | 17 |
| GL | 0.10 | 96 | 60.22 | 21.85 | 56.71 | 24.47 | 0.15 | 0.2 | 4 |
| Example 1b | | | | | | | | | |
| Control | | 96 | 59.87 | 21.78 | 56.00 | 24.68 | | | |
| PAPEMP | 0.33 | 96 | 62.46 | 21.06 | 59.33 | 23.40 | 3.33 | 1.28 | 19 |
| PAPEMP | 0.16 | 96 | 62.75 | 20.69 | 60.12 | 22.99 | 4.12 | 1.69 | 32 |
| GL | 1.00 | 96 | 60.70 | 21.46 | 58.45 | 23.30 | 2.45 | 1.38 | 42 |
| GL | 0.50 | 96 | 60.79 | 21.24 | 58.59 | 23.47 | 2.59 | 1.21 | 43 |

EXAMPLE 2: Thermal Aging

| Chemical | Dose, % to dry pulp | Time, h | Initial Br | Initial Ye | Final Br | Final Ye | GainBr | LessYe | % IBr |
|---|---|---|---|---|---|---|---|---|---|
| Example 2a | | | | | | | | | |
| Control | | 40 | 64.04 | 19.35 | 60.75 | 21.81 | | | |
| PAPEMP/$NaH_2PO_4$ | 0.08/0.25 | 40 | 67.57 | 17.80 | 65.64 | 19.92 | 4.89 | 1.89 | 41 |
| Example 2b | | | | | | | | | |
| Control | | 116 | 60.01 | 21.38 | 55.31 | 24.60 | | | |
| PAPEMP/$NaH_2PO_4$ | 0.08/0.25 | 116 | 62.37 | 21.08 | 58.85 | 23.58 | 3.54 | 1.02 | 25 |
| GL/$NaH_2PO_4$ | 0.25/0.25 | 116 | 62.24 | 20.96 | 58.43 | 23.70 | 3.12 | 0.9 | 18 |

EXAMPLE 3
Thermal aging of treated CTMP

| Chemical | Dose, % to dry pulp | Time, h | Initial Br | Initial Ye | Final Br | Final Ye | GainBr | LessYe | % Ibr |
|---|---|---|---|---|---|---|---|---|---|
| Example 3a | | | | | | | | | |
| Control | | 91 | 64.08 | 19.65 | 61.71 | 20.89 | 0 | 0 | 0 |
| PAPEMP/$NaH_2PO_4$/DMTDA | 0.03/0.25/0.0012 | 91 | 63.94 | 21.64 | 64.94 | 19.08 | 3.23 | 1.81 | 142 |
| GL/$NaH_2PO_4$/DMTDA | 0.1/0.25/0.0012 | 91 | 63.37 | 21.71 | 64.72 | 19.41 | 3.01 | 1.48 | 157 |
| PAPEMP/$NaH_2PO_4$/DMDTC | 0.03/0.25/0.002 | 91 | 61.64 | 23.40 | 63.13 | 20.57 | 1.42 | 0.32 | 163 |
| Example 3b | | | | | | | | | |
| Control | | 40 | 64.04 | 19.35 | 60.75 | 21.81 | | | |
| PAPEMP/$NaH_2PO_4$/DMTDA | 0.08/0.25/0.0025 | 40 | 60.44 | 24.38 | 64.11 | 20.59 | 3.36 | 1.22 | 212 |
| PAPEMP/$NaH_2PO_4$/DMTDA | 0.03/0.25/0.0025 | 40 | 62.40 | 22.77 | 63.84 | 20.78 | 3.09 | 1.03 | 144 |
| PAPEMP/$NaH_2PO_4$/DMDTC | 0.08/0.25/0.002 | 40 | 66.94 | 18.53 | 65.29 | 19.74 | 4.54 | 2.07 | 50 |
| PAPEMP/$NaH_2PO_4$/DMDTC | 0.03/0.25/0.002 | 40 | 65.91 | 18.49 | 64.9 | 20.04 | 4.15 | 1.77 | 69 |
| PAPEMP/$NaH_2PO_4$/DEDTC | 0.08/0.25/0.0012 | 40 | 67.65 | 17.96 | 64.93 | 20.34 | 4.18 | 1.47 | 17 |
| PAPEMP/$NaH_2PO_4$/DEDTC | 0.03/0.25/0.0012 | 40 | 67.59 | 17.72 | 65.36 | 19.83 | 4.61 | 1.98 | 32 |
| GL/$NaH_2PO_4$/DMTDA | 0.25/0.25/0.0025 | 40 | 62.19 | 22.09 | 64.32 | 20.84 | 3.57 | 0.97 | 165 |
| GL/$NaH_2PO_4$/DMTDA | 0.1/0.25/0.0025 | 40 | 60.73 | 22.85 | 63.64 | 20.89 | 2.89 | 0.92 | 188 |
| Example 3c | | | | | | | | | |
| Control | | 39 | 65.30 | 18.71 | 61.19 | 21.97 | | | |
| PAPEMP/$NaH_2PO_4$/DMTDA | 0.03/0.25/0.0012 | 39 | 65.13 | 20.53 | 65.06 | 20.21 | 3.87 | 1.76 | 98 |
| GL/$NaH_2PO_4$/DMTDA | 0.1/0.25/0.0012 | 39 | 65.83 | 19.66 | 64.34 | 20.39 | 3.15 | 1.58 | 63 |
| PAPEMP/$NaH_2PO_4$/DMDTC | 0.03/0.25/0.002 | 39 | 65.91 | 20.01 | 65.06 | 20.15 | 3.87 | 1.82 | 79 |
| GL/$NaH_2PO_4$/DMDTC | 0.1/0.25/0.002 | 39 | 66.01 | 19.59 | 63.81 | 21.24 | 2.62 | 0.73 | 46 |
| Example 3d | | | | | | | | | |
| Control | | 22 | 64.59 | 18.82 | 61.57 | 20.82 | | | |
| PAPEMP/$NaH_2$PO4/DMTDA | 0.08/0.25/0.0025 | 22 | 62.07 | 23.36 | 63.72 | 19.94 | 2.15 | 0.88 | 154 |
| GL/$NaH_2PO_4$/DMTDA | 0.25/0.25/0.0025 | 22 | 62.18 | 22.23 | 63.44 | 19.94 | 1.87 | 0.88 | 141 |
| GL/$NaH_2PO_4$/DMTDA | 0.1/0.25/0.0025 | 22 | 62.94 | 21.05 | 63.37 | 19.96 | 1.8 | 0.86 | 114 |
| Example 3e | | | | | | | | | |
| Control | | 16 | 64.79 | 19.35 | 61.69 | 20.22 | 0 | 0 | 0 |

-continued

EXAMPLE 3
Thermal aging of treated CTMP

| Chemical | Dose, % to dry pulp | Time, h | Initial Br | Initial Ye | Final Br | Final Ye | GainBr | LessYe | % Ibr |
|---|---|---|---|---|---|---|---|---|---|
| PAPEMP/$NaH_2PO_4$/DMTDA | 0.03/0.25/0.0012 | 16 | 63.83 | 20.6 | 64.48 | 19.2 | 2.79 | 1.02 | 121 |
| GL/$NaH_2PO_4$/DMTDA | 0.1/0.25/0.0012 | 16 | 65.23 | 19.84 | 64.33 | 19.36 | 2.64 | 0.86 | 71 |
| PAPEMP/$NaH_2PO_4$/DMDTC | 0.03/0.25/0.002 | 16 | 65.3 | 18.94 | 64.29 | 19.38 | 2.64 | 0.84 | 67 |
| GL/$NaH_2PO_4$/DMDTC | 0.1/0.25/0.002 | 16 | 65.61 | 18.55 | 63.91 | 19.14 | 2.22 | 1.08 | 45 |

What is claimed:

1. In a method of making paper with Mechanical Pulp comprising the steps of grinding or refining wood to create unbleached pulp and then bleaching the pulp and then forming paper from the pulp, the improvement comprising applying from about 0.01 weight percent to about 1 weight percent of a Penetrant Compound to the paper wherein said Penetrant Compound is selected from the group comprising polyamino polyether methylene phosphonate or α-glucoheptonic-γ-lactone.

2. The method of claim 1, wherein said Penetrant Compound consists of (a) from about 5 weight percent to about 95 weight percent of a compound selected from the group consisting of polyamino polyether methylene phosphonate and α-glucoheptonic-γ-lactone; and (b) from about 5 weight percent to about 95 percent of an inorganic salt, wherein said inorganic salt is selected from the group consisting of monobasic alkaline metal phosphates.

3. In a method of making paper with Mechanical Pulp comprising the steps of grinding or refining wood to create unbleached pulp and then bleaching the pulp and then forming paper from the pulp, the improvement comprising applying from about 0.01 weight percent to about 1 weight percent of a Penetrant Compound to the paper wherein said Penetrant Compound comprises (a) from about 5 weight percent to about 95 weight percent of Component 1, wherein Component 1 is selected from the group consisting of polyamino polyether methylene phosphonate and α-glucoheptonic-γ-lactone;

(b) from about 0.05 weight percent to about 10 weight percent of Component 2, wherein Component 2 is selected from the group consisting of 3,5-dimethylperhydrothiadiazine-2-thion and dialkyldithiocarbamates; and (c) from about 5 weight percent to about 95 weight percent of Component 3, wherein Component 3 is an inorganic salt, wherein said inorganic salt is selected from the group consisting of monobasic alkaline metal phosphates.

4. The method of claim 1 in which said Penetrant Compound is polyamino polyether methylene phosphonate.

5. The method of claim 1 in which said Penetrant Compound is α-glucoheptonic-γ-lactone.

6. The method of claim 2 in which said inorganic salt is monobasic sodium phosphate.

7. The method of claim 3 in which said Component 1 is polyamino polyether methylene phosphonate.

8. The method of claim 3 in which said Component 1 is α-glucoheptonic-γ-lactone.

9. The method of claim 3 in which said Component 2 is 3,5-dimethylperhydrothiazdiazine-2-thion.

10. The method of claim 3 in which said Component 2 is dimethyldithicarbamate.

11. The method of claim 3 in which said Component 2 is diethyldithicarbamate.

12. The method of claim 3 in which said Component 3 is monobasic sodium phosphate.

* * * * *